US006346035B1

(12) United States Patent
Anderson et al.

(10) Patent No.: US 6,346,035 B1
(45) Date of Patent: Feb. 12, 2002

(54) GENERATION OF AN AIRSTREAM WITH SUBLIMINABLE SOLID PARTICLES

(75) Inventors: Robert Anderson, Whittier; Alan E. Opel, Monrovia; Philip Spivak, Toluca Lake; Oleg Zadorozhny, North Hollywood, all of CA (US)

(73) Assignee: CAE Alpheus, Inc., Rancho Cucamonga, CA (US)

( * ) Notice: Subject to any disclaimer, the term of this patent is extended or adjusted under 35 U.S.C. 154(b) by 0 days.

(21) Appl. No.: 09/333,087

(22) Filed: Dec. 24, 1998

(51) Int. Cl.[7] ..... B24C 7/00
(52) U.S. Cl. ..... 451/99; 451/446
(58) Field of Search ..... 451/2, 39, 40, 451/75, 99, 446; 222/636, 345, 346, 348

(56) References Cited

U.S. PATENT DOCUMENTS 4,389,820 A * 6/1983 Fong et al.
4,463,736 A * 8/1984 Hayward, Jr.
4,744,181 A * 5/1988 Moore et al.
5,109,636 A * 5/1992 Lloyd et al.
5,520,572 A 5/1996 Opel et al.

* cited by examiner

*Primary Examiner*—Timothy V. Eley
(74) *Attorney, Agent, or Firm*—Donald D. Mon

(57) ABSTRACT

Apparatus to prepare an airstream laden with particles of solid dry ice. A rotor has passages which sequentially pass a source of particles and a source of air under pressure to prepare the airstream and send it to a nozzle. The rotor is held between pads whose force against the rotor is a function of air supply pressure. The speed of the rotor and of the particle feed are controllable, and the air feed persists after particle feed has stopped for a period of time sufficient to clear particles from the rotor.

4 Claims, 4 Drawing Sheets

GENERATION OF AN AIRSTREAM WITH SUBLIMINABLE SOLID PARTICLES

FIELD OF THE INVENTION

Apparatus and method for preparing and discharging an airstream laden with subliminable solid particles (for example, dry ice). The term "subliminable" as used herein includes "evaporable".

BACKGROUND OF THE INVENTION

Abrading and cleaning a surface by an air blast with entrained solid particles of a subliminable material is well-known. Dry ice is the best known substance for this purpose. Evaporable substances are included herein as subliminable, although subliminable materials are to be preferred. Among its advantages is the fact that in contrast to silica sand, it simply disappears after it has struck the surface to be cleaned, and its properties on impact are much more forgiving to the impacted surfaces.

The art includes many examples of apparatus which reduce blocks of solid carbon dioxide to particles of useful size to meter previously made particles of dry ice and then entrain them in an airstream which exits through a nozzle to impact a surface. The seeming simplicity of entraining particles of dry ice in an airstream is confounded by the physical properties of the product itself.

The dry ice is very cold, and as such chills everything it touches and closely approaches. The particles will readily aggregate into large lumps, with a different impact effect than the individual particles would have. Even worse, their aggregates tend to clog conventional metering and feeding mechanisms by freezing up in their chilled structures.

These problems are well known to manufacturers and users of apparatus for these processes, and the art is replete with efforts, some of them by the inventor herein, to improve on the situation. In view of the fact that the process involves no more than the reduction of a solid body of carbon dioxide into particles, and then transporting the particles to and through a nozzle, it is surprising that there still exists the need for further improvements to systems which already have been carefully and cleverly devised. However, such is in fact the situation.

Reduction of a larger body of solid carbon dioxide into particles and metering of particles is reasonably well developed. For example, see Opel et al U.S. Pat. No. 5,520,572. The problem arises in feeding these particles into a high pressure airstream, with a uniform and properly proportioned content of the particles, always available on demand, which is often intermittent and variable.

For this purpose some type of proportionalizing air lock equipment is needed. Known devices try to perform both functions and include moving elements which have cavities to receive the particles, and which function to supply them at an agreed rate. For example, push-pull plates and rotary star wheels are known whose cavities arrive at a supply station with a known frequency and discharge their contents at that frequency.

The customary approach to this requirement is to adjust the rate of supply of particles by fully filling the cavities in a feed mechanism, and then varying the rate of supply by adjusting the frequency at which the cavities arrive at their junction with the airstream. This is a satisfactory arrangement, but only within surprisingly narrow limits. As the demand for particles decreases, for example when a lesser flow is defined by the outlet nozzle, the filled cavities will discharge with a lesser frequency. This leads to a pulsating flow of particles at the nozzle which often does not produce a suitably uniform stream of particles.

Worse still, as stated above, at these slower rates the particles in the cavities can congeal to form larger agglomerates. This is serious enough, but when the wheel turns too slowly or stops with the cavities full, the particles can freeze in the cavity, and cannot be blown into the stream at all. Occurrences are frequent when the system must be shut down and the cavities cleared out before the system can be started again.

It is an object of this invention to provide apparatus and method to meter particles and entrain them into a pressurized airstream of any velocity and which also may demand more or fewer particles per unit of time, and more or less volume of air which airstream has only minimal fluctuations in the rate of particle presence at the nozzle.

It is another object of this invention to provide apparatus and method in which the particles do not tend to aggregate or to plug up the system or any part of it, especially in its air lock through which high pressure air is introduced into the stream.

BRIEF DESCRIPTION OF THE INVENTION

A system according to this invention includes a source of dry ice particles, an adjustably variable-rate metering element, an air lock element, an adjustably regulable air supply, an air lock element receiving and combining both particles and air, a hose receiving a combined stream of air and particles from the air lock, and a nozzle discharging the particle-combining stream from the hose.

According to a preferred but optional feature of the invention, the metering element is a rotary auger, and the air lock element includes a rotor pierced by a plurality of separate passages disposed as a ring around the center of rotation of the rotor.

According to another preferred but optional feature of the invention the metering element and air lock element are separately controlled, such that the air lock element is in operation at all times when the metering element is operating and continues to operate after the metering element stops, whereby to clear the air lock element of any residual particles to prevent clogging.

According to yet another feature of the invention, the rate of rotation of the air lock element is independent of the feed rate from the metering element.

The above and other features of this invention will be fully understood from the following detailed description and the accompanying drawings, in which:

DETAILED DESCRIPTION OF THE INVENTION

Figure 1:
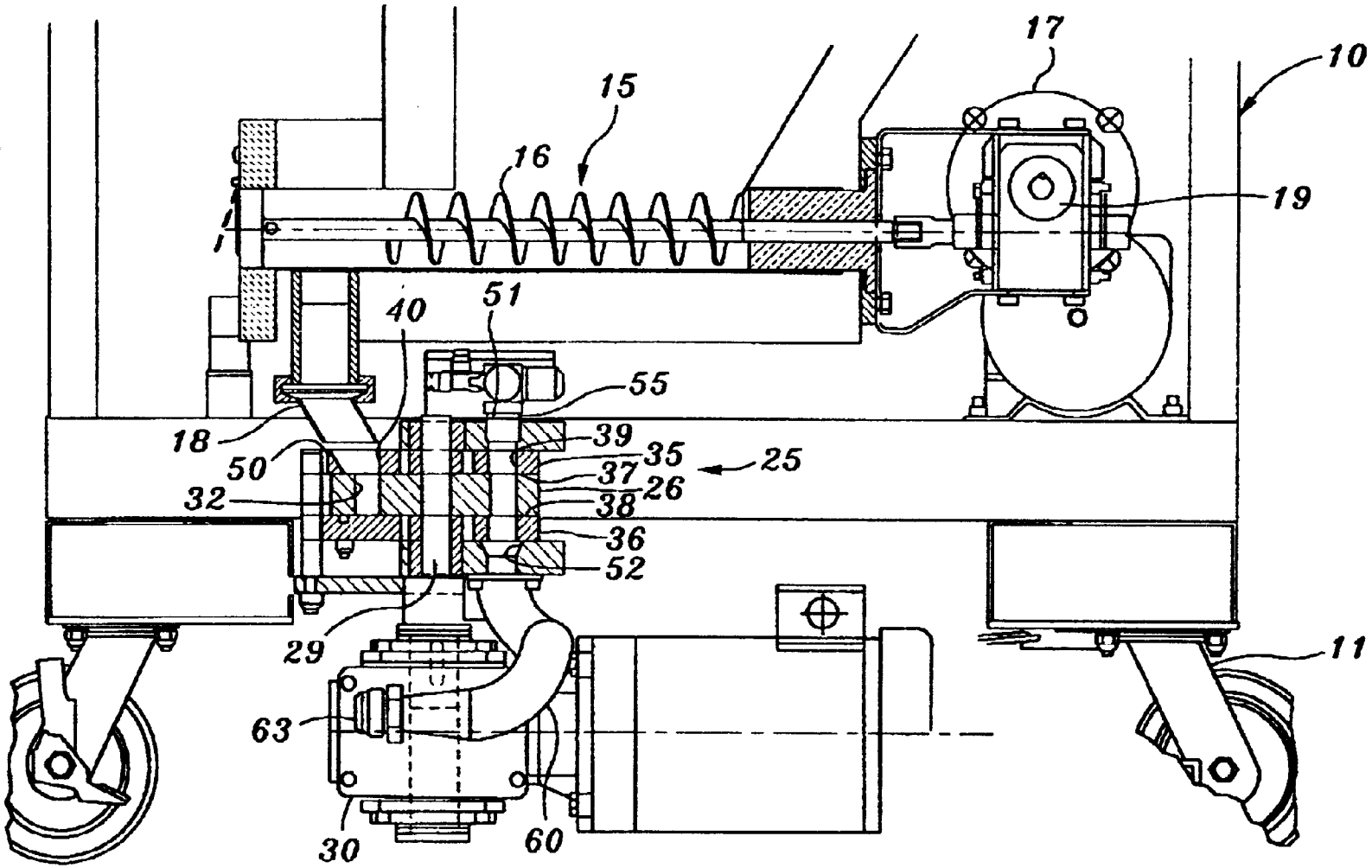
FIG. 1 is a side view partly in cross-section, showing the preferred embodiment of the invention.
Figure 3:
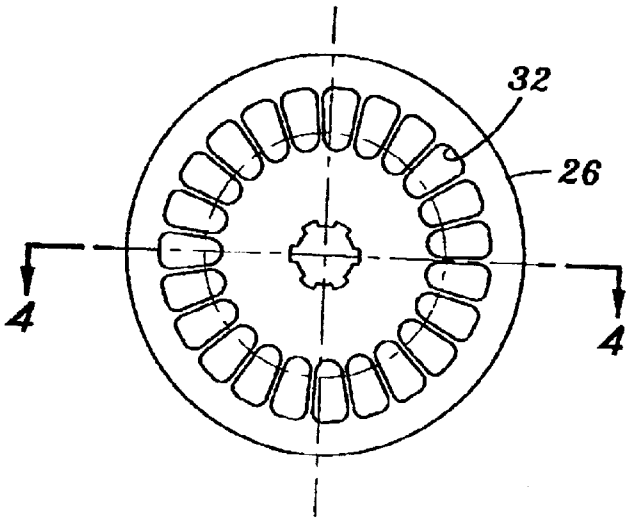
FIG. 3 is a plan view of a rotor used in this invention.
Figure 4:
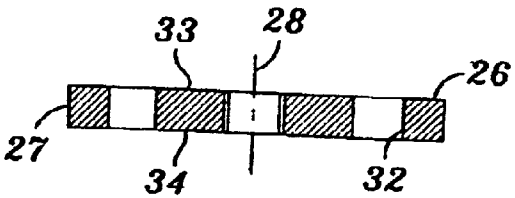
FIG. 4 is a cross-section taken at line 4—4 in FIG. 3.

A source 10 of solid carbon dioxide particles is schematically shown on a wheeled support 11. This may be any desired type of device whose details form no part of this invention and therefore are not described in detail. Full details of preferred apparatus for use herein will be found in Opel et al U.S. Pat. No. 5,520,572, which is incorporated herein in its entirety for its showing of such apparatus.

Particles are provided to a screw auger 15, frequently referred to herein as a "metering element". This auger is conventional, with a helical rib 16 that is rotated around a central axis. It is rotated by an adjustable speed motor 17. A given angular rotation of the auger will move a known amount of particles to a delivery chute 18. An auger control 19, schematically shown, can variably adjust the rate of rotation of the augur and thereby the feed rate of particles, and can also shut off the motor 17.

Figure 2:
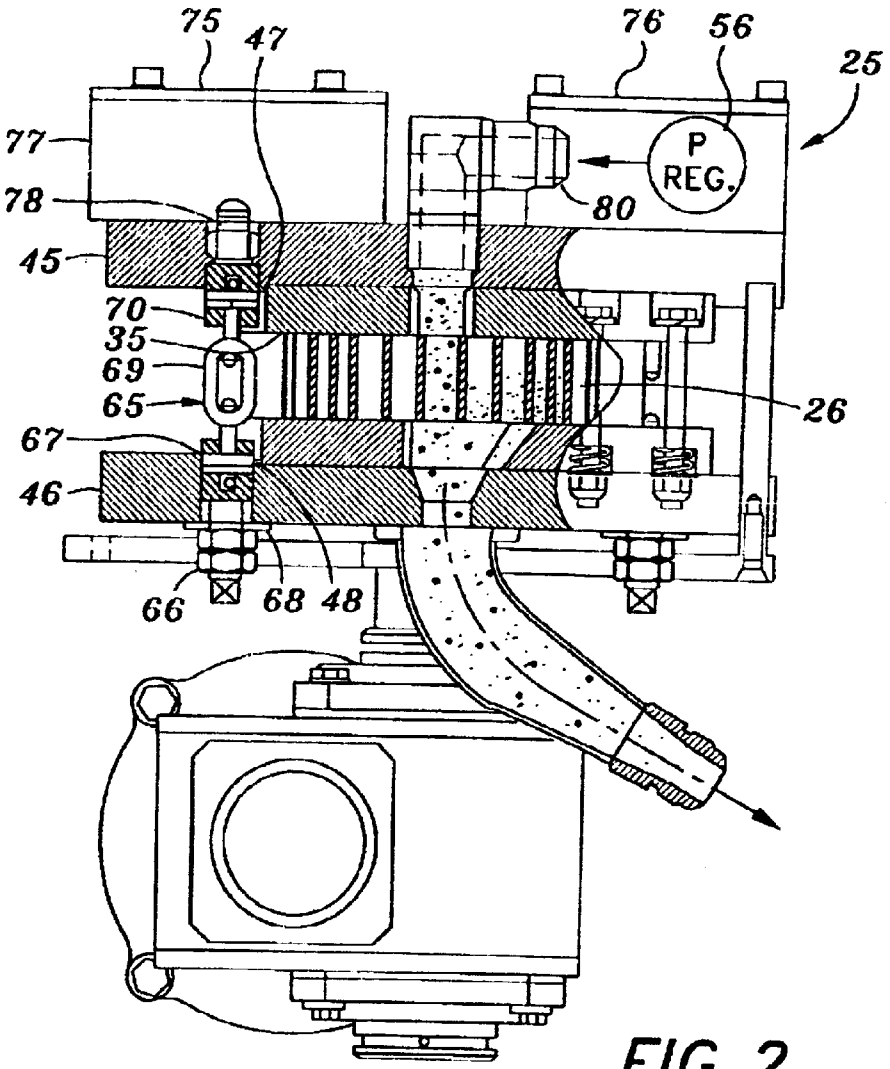
FIG. 2 is an enlarged view of a portion of FIG. 1.
Figure 6:
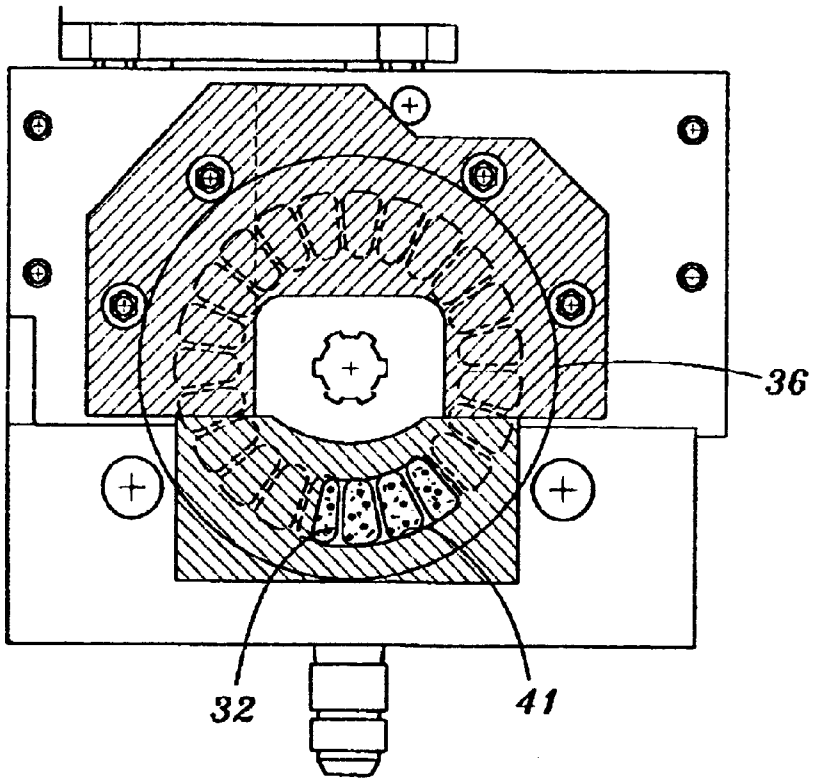
FIGS. 5 and 6 are overlay views showing the relationship of ports on both sides of the rotor.
Figure 5:
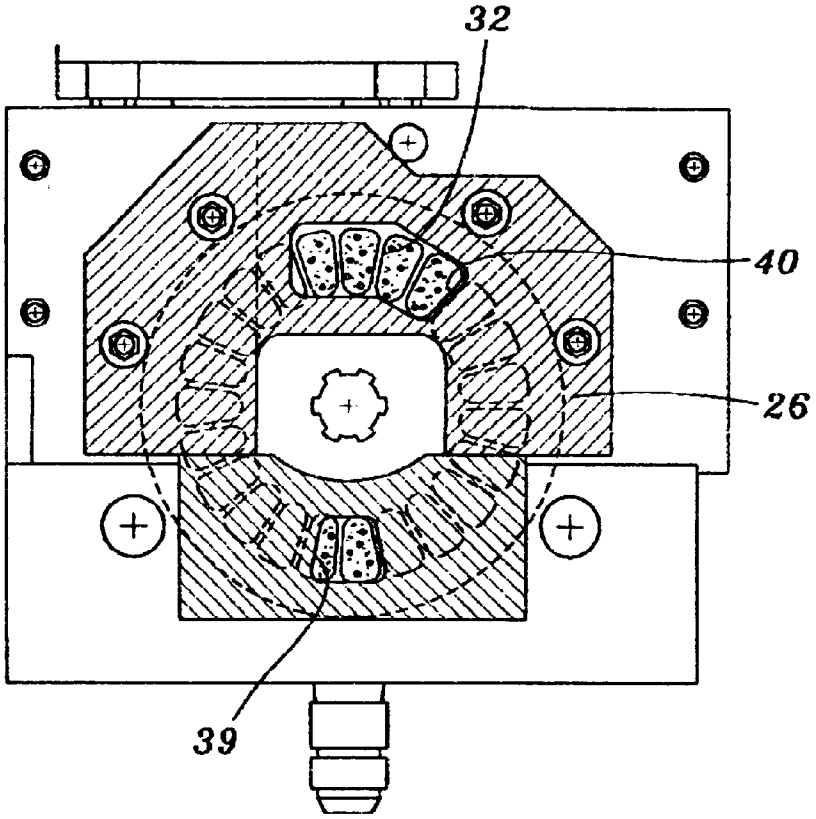

An air lock element 25 (FIGS. 1 and 2) is provided in which air and particles are combined to form the desired output stream. It also acts to seal pressurized air from the atmosphere, and permits the particles to be received at atmospheric pressure.

A rotor control 26 is a disc-shaped plate 27 with a central axis of rotation 28. The rotor is fixed to a rotary drive shaft 29. The shaft is driven by an adjustable speed motor 30. A rotor control 31 (FIG. 9) variably adjusts the speed of the motor, and can also shut it off.

A series of ports 32 is formed in a ring pattern around the central axis, each one extending from upper surface 33 to lower surface 34. An upper pad 35 and a lower pad 36 have respective flat surfaces 37 and 38 which bear against surfaces 33 and 34 in a sliding sealing contact.

Upper pad 35 has an air passage 39 and a particle passage 40 through it. These are arcuately spaced apart. The particle passage can conveniently be made somewhat funnel-shaped to facilitate the flow of particles into ports 32.

Lower pad 36 has an exit passage 41 through it, preferably somewhat enlarged at its end adjacent to the rotor.

An upper pad holder 45 and a lower pad holder 46 press the pads against the rotor. The pads fit in non-circular recesses 47, 48 in the pad holders.

The pad holders do not rotate, and they hold the pads against rotation. Upper pad holder 45 has a step 50 giving access from the chute to port 40, and an air passage 51. The lower pad holder has an exit port 52 through it which is aligned with exit passage 36.

Particles are discharged from the chute into passage 40, which is open to atmosphere. Ports 32 are closed to atmosphere by the air lock except when they register with passage 40.

A high pressure air line 55 is connected to an air passage 51 in the upper pad holder. An adjustably variable control 56 adjusts the pressure and rate of flow of air delivered to air passage 51, as a function of system demand.

An outlet hose 60 is connected to the lower pad holder at exit port 52 which leads to a nozzle 63.

The pads are preferably made of a hard organic plastic material such as ultra high molecular weight (UHMW) polyurethane. It has good wear qualities against metal and withstands the very cold temperatures that are involved. The pad holders will usually be made of a suitable steel.

Figure 8:
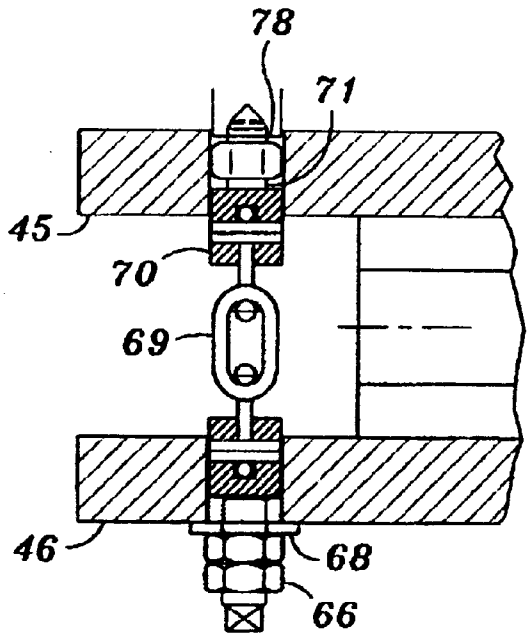
FIG. 8 is an enlarged view of a portion of FIG. 1.

The sandwich structure of pads, pad holders and rotor are held as a unit by links 65, a typical link being shown in FIG. 8. Link 65 includes a lower retainer 66 which fits in a hole 67 in the lower pad holder, with a washer 68 that bears against the bottom of the lower pad holder. A chain link 69 joins retainer 66 to an upper retainer 70 which freely passes through a hole 71 in the upper pad holder.

A pair of piston-cylinder assemblies 75, 76 each having outer cylinder 77 and a piston/shaft 78 have their cylinders fixed to the upper pad holder, and their shaft fixed to the respective upper retainer 70. Pulling on the shaft will place the stack between the cylinder and the end of its shaft in compression with a force against the stack which is proportional to the pressure exerted in the cylinder. An air line 80 with an adjustable pressure regulator 56 establishes this force. A spring (not shown) inside the cylinder bearing against the piston exerts a small prevailing compression force when no air pressure is applied.

In use, a greater force will be exerted in cylinder assembly 75, because a tighter seal is necessary at the side where the air pressure for the stream would tend to leak. A lesser force is needed at the particle entry, because only atmospheric pressure is present there.

Figure 9:
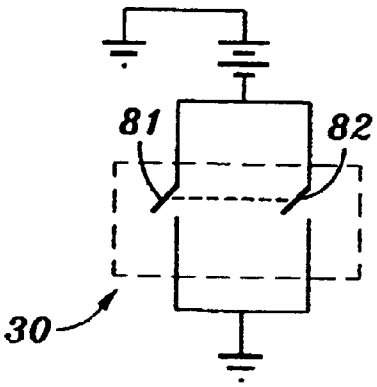
FIG. 9 is a schematic circuit drawing showing a control for the motor.

Control 31 for motors 17 and 30 is schematically shown in FIG. 9. There is a switch 81 for the metering element drive, (the "auger control") a switch 82 (the "rotor control") for the rotor shaft drive. These are ganged so as to be closed by a single push, such as by a pilot actuated by a separate switch (not shown) at the nozzle. Closure of both switches, which is simultaneous, will start both motors and therefore the feeding of particles to the air lock and the rotation of the rotor to pass a stream of pressurized air with particles.

However, when the demand ceases, the switches will be opened to stop the action. Switch 81 opens immediately. Switch 82 remains closed, for the predetermined period of time shown in FIG. 7 to clear the system. Any suitable delay means may be provided, for example a mechanical timer which holds switch 82 closed for that time, or an electrical latch circuitry circuity which will by-pass switch 82 for the predetermined period of time. After that time elapses, both switches will be open, and the system will be purged and stopped.

This construction provides an air lock which is well sealed at the entry of pressurized air, and made of simple long wearing parts. The device has elegantly simple parts which wear well and are readily repaired and replaced.

Figure 7:
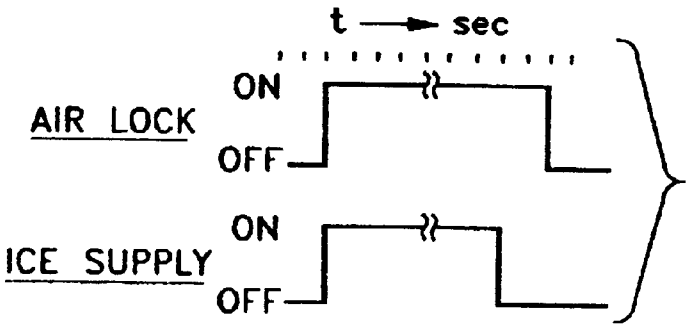
FIG. 7 is a schematic showing of a time relationship in the method of this invention.

More particularly as a system, this apparatus is adapted for operation in such a way as to preclude freezing up in its rotor. As shown in FIG. 7, it is intended that the rotor never have particles in it unless it is rotating and the airstream is blowing through its ports. For this purpose, the control of rotor rotation, by the rotor control, will maintain the rotor in operation until after a period of time following the stopping of the auger sufficient that all rotor ports will have passed the air entry at least one time after all particles have left the chute and have been blown from the rotor and out of the nozzle. This automatic purge of the system will prevent its freezing up.

FIG. 7 illustrates the extension of time during which the rotor continues to turn, while only air is fed to the rotor.

In addition, it is best practice to operate the rotor at a speed which will result in fewer pulsations of particles. An optimum rotational velocity to produce discharges from rotor ports with a frequency at least about 800 pulses per minute regardless of the rate of particle supply will provide a more consistent combined stream. Often the drive motor for the rotor will not be adjustable, because a suitable frequency will be useful for all flow rates, and rotor rate is independent of the particle feed rate.

This invention is not to be limited by the embodiments shown in the drawings and described in the description, which are given by way of example and not of limitation, but only in accordance with the scope of the appended claims.

We claim:

1. Particulate blasting apparatus comprising:

an adjustable variable speed metering element delivering particles of solid carbon dioxide at a selected rate;

an air lock element comprising a rotor having a central axis of rotation, an upper and a lower flat rotor surface axially separated from one another, and parallel to one another, a plurality of separate rotor ports disposed in a ring array around said axis, extending between said rotor surfaces;

an upper and a lower non-rotating pad each having a flat surface bearing against a respective upper and lower rotor surface, an upper and lower pad holder, said upper pad holder having a particle port disposed to receive particles and discharge said particles to rotor ports as they pass said particle port, and an air port disposed to receive air under pressure and discharge air to said rotor ports as they pass said air port, said lower pad holder having a receiving port aligned with said air port disposed to receive the contents of rotor ports as they pass said receiving port together with air from said air port;

a chute for discharging particles from said metering element to said particle port;

air supply means for providing air under adjustable pressure to said air port in said upper pad; and bias means for biasing said pads against said rotor;

said bias means comprising a pneumatic cylinder whose bias pressure is proportional to the pressure of the air supplied to the air lock.

2. Apparatus according to claim 1 in which the pads are made of ultra high molecular weight (UHMW) polyurethane.

3. Apparatus according to claim 1 in which said metering element is a rotatable auger, and adjustable auger control is provided to control the rate of rotation of the auger, and in which a rotor control is provided to cause said rotor to stop or be rotated, said auger control and rotor control being inter-related such that the rotor will continue to turn for a predetermined period of time after the auger has stopped.

4. Apparatus according to claim 3 in which a hose with a nozzle is connected to the receiving port of the lower pad holder, said rotor control requiring continued rotation of the rotor until after all particulates have passed through the nozzle.

* * * * *